United States Patent [19]

Ito et al.

[11] 3,950,191

[45] Apr. 13, 1976

[54] COLD ROLLED STEEL SHEETS HAVING AN EXCELLENT ENAMELABILITY AND A METHOD FOR PRODUCING SAID COLD ROLLED STEEL SHEETS

[75] Inventors: Kenji Ito; Isao Takahashi, both of Chiba; Yo Ito, Kurashiki; Takuo Imai, Chiba; Fumio Kosumi; Hideo Kuguminato, both of Chiba, all of Japan

[73] Assignee: Kawasaki Steel Corporation, Kobe, Japan

[22] Filed: Oct. 21, 1974

[21] Appl. No.: 516,407

[52] U.S. Cl. ..... 148/12.1; 75/123 B; 148/36

[51] Int. Cl.[2] ..... C21D 9/48

[58] Field of Search ..... 148/12 C, 12.1, 36; 75/123 B

[56] References Cited

UNITED STATES PATENTS

| | | | |
|---|---|---|---|
| 2,768,892 | 10/1956 | Shoenberger | 148/12 C |
| 3,239,390 | 3/1966 | Matsukura et al. | 148/12.1 |
| 3,417,463 | 12/1968 | Knuppel et al. | 29/528 |
| 3,725,143 | 4/1973 | Alworth et al. | 148/36 |

*Primary Examiner*—W. Stallard

[57] ABSTRACT

Steel sheets having an excellent enamelability are produced by adjusting the carbon, silicon, manganese, aluminum, oxygen and boron contents in a molten steel to be not more than 0.020% of carbon, not more than 0.03% of silicon, not more than 0.50% of manganese, not more than 0.010% of aluminum, nor more than 0.050% of oxygen, boron within a range of 0.003–0.020% being in such an amount B(%)×0(%) of more than $1\times10^{-5}$ and the remainder being inevitable impurities and iron, and hot rolling the resulting steel, cold rolling the steel and subjecting to a recrystallization annealing in a conventional manner.

5 Claims, 3 Drawing Figures

COLD ROLLED STEEL SHEETS HAVING AN EXCELLENT ENAMELABILITY AND A METHOD FOR PRODUCING SAID COLD ROLLED STEEL SHEETS

The present invention relates to cold rolled steel sheets having an excellent enamelability and a method for producing said cold rolled steel sheets.

Enameling steel sheets encounter various defects and among them there are "fish scale", "low adherence," "boiling," "bristers," "pinhole," "sagging" and the like.

The "fish scale" is the defect, in which the chipping off similar to nails occurs a few hours or a few weeks after the firing operation and the cause for formation of the fish scale is presently considered as follows. Water in the firing atmosphere or in the raw material of the vitreous enamel is decomposed during the firing of the enamel to form hydrogen, which is absorbed in the base iron and the hydrogen diffuses out on the surface of the base steel sheet with lapse of time and aggregates at small cavities of the interface between the enamel layer and the base steel sheet and consequently the hydrogen generates a very high pressure at these portions and the enamel layer is explosively broken.

Thus, the causes influencing upon the formation of the fish scales are considered to be as follows.

a. The moisture in the firing atmosphere and the water present in the raw material of enamel, b. Adhesive strength of the enamel layer to the base steel sheet, and c. The volume of the bubbles present in the enamel layer in the vicinity of the base steel sheet after the firing (effective for reducing the pressure of the hydrogen gas).

However, in addition to the above described three factors, the tendency for forming the fish scale varies depending upon the property of the base steel itself and the reason relies firstly upon that the amount of hydrogen absorbed upon the firing of enamel essentially varies depending upon the property of the steel and this is influenced by the carbon content.

When the usual low carbon content steel sheet contaning more than 0.02% of carbon is heated over A, transformation point of 723°C, the austenite phase is formed and at a constant temperature condition, the higher the carbon content, the larger the formed amount is. This austenite phase is larger in the dissolution capacity of hydrogen than the ferrite phase, so that as the carbon content of the steel sheet is higher, the amount of hydrogen absorbed becomes larger when compared at the same temperature for firing the enamel. Other than this reason, the carbon contained in the enameling steel sheet is harmful in view of the formation of boiling, blisters, pinholes or sagging, so that it is common sense that the carbon content for the steel to be used for enameling is preferred to be lower.

As the means for lowering the carbon content of the steel for enameling, the process for effecting the oxidation refining for a longer time at the steel making step has been adopted but if the carbon content is reduced to less than 0.02% by this process, not only the cost increases, but also the oxygen content in the steel increases and the surface and the quality of the formed steel sheet are considerably deteriorated.

Therefore, the open coil annealing process by which the carbon content is easily reduced to about 0.002% by annealing the cold rolled low carbon steel sheet in a wet hydrogen gas atmosphere, has been developed and almost all of the high class enameling steel sheets have been produced by this process.

Recently, it has been able to make decarburization cheaply to the carbon content of about 0.005% by effecting the degassing treatment under vacuum upon steel making but when the resulting steel is used as the base steel, other difficulties occur in order to produce the rolled steel sheet for enameling having excellent properties under the usual production conditions.

That is, such a steel having a very low content of carbon becomes higher as near 890°C in the $Ar_3$ transformation point and if such a steel is rolled at a usual temperature of about 850°C, the steel is subjected to hot rolling in the ferrite region and the aggregate texture predominant in [001] face is formed and this texture influences upon the texture even after the annealing of the cold rolled steel and both the press formability and the enamelability are simultaneously deteriorated.

Thus, in order to hot roll the steel having a very low content of carbon, such as 0.005% carbon, produced by the degassing treatment under vacuum in the region of the austenite phase in the same manner as in the usual low carbon steel and to adjust the hot rolled aggregate texture or the final annealed texture to a desirable state, the hot rolling should be finished at a temperature of higher than 890°C, but this is very difficult in view of the rolling installation and the quality deterioration of the steel sheet surface owing to formation of a large amount of scales. On the other hand, the deterioration of the enamelability has not yet been clarified in detail but it is considered that the corrosion state of the steel surface after pickling which is effected as a pretreatment of enameling, the state of deposition of nickel based thereon and the amount of hydrogen absorbed vary owing to the difference of the texture of the sheet and consequently the formation of the fish scales is influenced.

The second cause by which the formation of the fish scales is influenced, is the hydrogen occludability of steel and the hydrogen occludability of steel is highly influenced by the amount and form of the inclusions in the steel.

In addition, it has been well known that the amount of the inclusions in the steel is positively increased in order to produce the steel sheet having an excellent enamelability, but if the amount of the inclusions in the steel is increased, the mechanical properties, particularly the press formability is degraded and further there is the danger that the inclusions exposed on the surface increase. The inclusions exposed on the surface become the cause of the blisters and fish scales after firing of the enamel and therefore the increase of the amount and the positive addition of the inclusions in the production of the steel sheet for enamel are always dangerous and unstable technic and the practical embodiment of such technic is few.

From the above mentioned facts, if it is possible to produce the cold rolled steel sheet cheaply in which the hydrogen absorption upon the enameling operation is small, the hydrogen occludability is high and the surface has no defects, such a production is very valuable.

The inventors have made various investigations and succeeded by defining the contents of carbon, silicon, manganese, aluminum, oxygen and boron, whereby the above described three requirements can be satisfied and the steel sheet having an excellent enamelability can be obtained.

That is, the present invention consists in a method for producing a cold rolled steel sheet having an excellent enamelability characterized in that upon the steel making, the following components are adjusted so that carbon is not more than 0.02%, silicon is not more than 0.03%, oxygen is not more than 0.050%, manganese is not more than 0.50%, aluminum is not more than 0.010%, and boron is 0.003–0.020%, preferably 0.005–0.012%, the product of boron (%) and oxygen (%) being more than $1\times10^{-5}$ and the remainder being inevitable impurities and substantially Fe and the resulting steel is subjected to a conventional rolling steps to form a sheet.

In the present invention, any particular conditions which increase the cost, are not necessary in the steps following to the hot roll.

Namely, inspite of the super low carbon steel sheet having the carbon content of not more than 0.02%, it is not necessary to raise the hot finishing temperature in the hot strip mill rolling to higher than 890°C and it is not always necessary to effect the decarburization annealing in the annealing step.

The reason why the advantages are obtained in the hot rolling and the next steps as compared with the conventional process for producing the steel sheets for enamel, relies upon the combination of the adjusted defined contents of six elements of carbon, silicon, manganese, aluminum, oxygen and boron.

The reason for defining the contents of the above described chemical elements characterized the present invention will be explained hereinafter.

Concerning the carbon content, when said content exceeds 0.02%, the linear defect due to blowhole is liable to be formed on the formed steel sheet surface other than the general tendency of the above described deterioration of the enamel properties and the enamel defects, such as fish scales and pinholes are apt to be formed on the said linear defect portion after the enameling operation. On the other hand, when the carbon content is less than 0.005% upon the steel making, such an amount is not preferable in view of the steel making efficiency.

When the carbon content is reduced to less than 0.005% by the decarburization annealing, the deep drawability of the cold rolled steel sheet is noticeably improved and this is preferable.

Silicon is an element which hinders the adherence of the enamel and when the content exceeds 0.03% in either of the usual double coat enameling or the single coat enameling, the adherence considerably lowers as shown in FIG. 1, so that this upper limit is necessary. For attaining this object, it is essential not to use silicon for adjusting the deoxidation.

Concerning the manganese content, when this content is increased, the strength increases and the press formability lowers, so that the upper limit of 0.05% is necessary.

Concerning the aluminum content, when this content increases, the nonmetallic inclusions of $Al_2O_3$ series are exposed on the steel sheet surface and the surface properties are not only deteriorated, but also the defects of fish scale, pinhole and the like are caused on the said exposed inclusion portion after the enameling and this is not preferable. When aluminum and boron are present together, as seen from FIG. 2, as the amount of aluminum increases, Lankford ratio ($\bar{r}$ ratio) lowers and the press formability is degraded, so that the upper limit of 0.01% is necessary.

Concerning the oxygen content, when said content is increased, the inclusions of oxides generally increase and are injurious for the press formability and the surface quality, while the hydrogen occludability becomes high, so that the enamelability is improved. However, in the present invention, the resulting steel sheet has a high hydrogen occludability due to the function of combination of oxygen and boron, so that it is not necessary to intentionally increase the oxygen content and rather the surface defect harmful for the enameling operation is caused. Accordingly, in order to positively avoid this defect, the upper limit of 0.050% is necesary.

Boron serves to enhance the hydrogen occludability in the steel of the present invention and to vary the recrystallized texture of cold rolled steel sheets and the addition of boron mainly aims at to improve the enamelability through these effects.

Concerning the addition of boron to the steel sheet for enameling, the technic utilizing the formation of nitride in the steel by boron has been well known but the present invention is essentially different from this technic in the range of the chemical components upon the steel making and the mechanism and the effect of boron.

That is, in the already known technic, boron is used for attaining the same effect as in aluminum and vanadium so that no solid solution of nitrogen, which causes an aging, is formed in the product. But in the present invention, the boron relates to the hydrogen occludability of the steel sheet and it is important to show the combination function with oxygen. Therefore, the boron cannot be replaced with the other nitrogen fixing elements.

There are the solid solution of boron, nitride, carbide and oxide as the form of boron present in the steel but the inventors have found that among them the fine boron oxide has the function by which the hydrogen occludability is considerably increased and in order to utilize the synergistic effect, it is ncessary to adjust the amount of boron oxide and the form distribution, so that the independent limitations of the amount of boron and oxygen is not effective and it is essential to define the lower limit of B(%)×O(%) of $1\times10^{-5}$. Moreover, boron is an element having a deoxidizing activity and the solubility product in the molten steel is about $4\times10^{-4}(\%)^2$ and therefore it has no significance to define the upper limit of B(%)×O(%).

When the nitrogen content is too large, BN is formed and this formation adversely affects on the fish scale defect and therefore the nitrogen content must be limited to less than 0.01%.

The above described hydrogen occludability can be compared by the permeation delay time of hydrogen observed at one side of a sample piece when another side of the sample piece is subjected to a cathodic electrolysis in an aqueous solution of sulfuric acid.

That is, when an electrolysis is effected in an aqueous solution of sulfuric acid by using one side of the steel sheet as a cathode and platinum as an anode, the nascent hydrogen is generated on the surface of the sample.

A part of this hydrogen is dissolved and diffused into the steel and passes through into the back side of the steel sheet and when the variation of the amount of hydrogen permeated with time is measured, the hydrogen is only solid solved in the steel at the original stage of the electrolysis and the hydrogen permeated at the back of the smaple is not observed but only after a certain time lapses, the permeated hydrogen is observed.

The time until the permeated hydrogen is observed from the start of the electrolysis, that is the delay time of the hydrogen permeation corresponds to the hydrogen occludability of the steel and the sensitivity of the fish scale of the steel sheet can be accurately estimated by this value.

Following to the experimental result of this test, it will be explained that it is necessary to concurrently define both the contents of boron and oxygen.

FIG. 3 show the results when the pure iron having a low oxygen content and the steel added with boron are subjected to an internal oxidation by a high temperature annealing in a wet hydrogen to form the samples, in one of which the fine boron oxide is dispersed. With respect to these samples, the delay time of the hydrogen permeation is measured.

As seen from the data of FIG. 3, even if the pure iron is subjected to the internal oxidation, the hydrogen occludability is not increased so much, while the steel added with boron is not substantially varied from the pure iron, although when this is subjected to the internal oxidation, the hydrogen occludability is very noticeably increased.

The present invention is characterized in that the remarkable property which the boron oxide occludes hydrogen, is utilized for improving the properties of the steel sheet for enameling but it is difficult industrially to effect the internal oxidation by annealing the steel in a wet hydrogen for the formation of boron oxide, so that the above described limitation of B(%)×O(%) is carried out upon the steel making and the present invention has succeeded in the accomplishment of the object.

In the present invention, the conditions of the subsequent steps after the rolling are not necessary to be so much strict but the process for adjusting the components upon the steel making needs a high technic, so that an explanation will be made with respect to this point.

In order that the most important value of B(%)×O(%) in the present invention is surely obtained, it is important to accurately presume the oxygen percent but in order to obtain this object by decreasing the carbon content to not more than 0.02%, it is most easy to strengthen the decarburization at degassing treatment under vacuum. However, in this case the amount of oxygen lowers attending to the decarburization, so that it is necessary to appropriately select the balance of carbon and oxygen when starting the vacuum treatment.

When the oxygen content is superfluous, it is necessary to adjust the amount of oxygen by the deoxidizing agents except silicon, such as manganese, aluminum, titanium, zirconium and the like but when the elements of aluminum. titanium, zirconium and the like, which are higher in the affinity to oxygen than boron, are used in an excess amount, the oxygen content considerably decreases and does not coincide with the object of the steel of the present invention, so that such a use should be taken care.

It is not necessary to take a particular attention to chromium and the elements which are weaker in the affinity with oxygen than chromium and in order to obtain the desired strength of the product, it is possible to select the optional component range. The phosphorus and sulfur contents which are inevitable impurities are defined to be less than 0.035% following to the usual standard of the steel sheet for enamel.

Even if the steel of the present invention is made by either of an ingot process or a slab continuous casting process, the excellent properties are not varied.

The present invention will be explained in more detail.

For a better understanding of the invention, reference is taken to the accompanying drawings, wherein.

Figure 1:
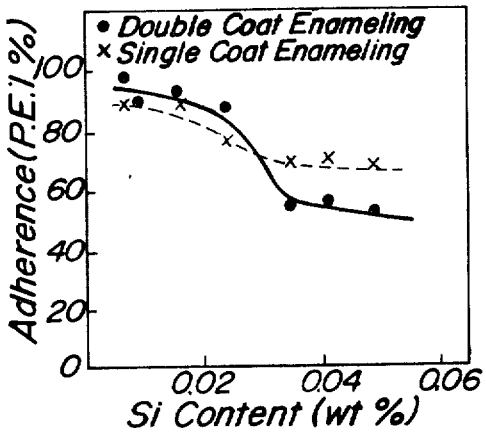
FIG. 1 is a graph showing the relation of the adherence of enamel to the silicon content.
Figure 2:
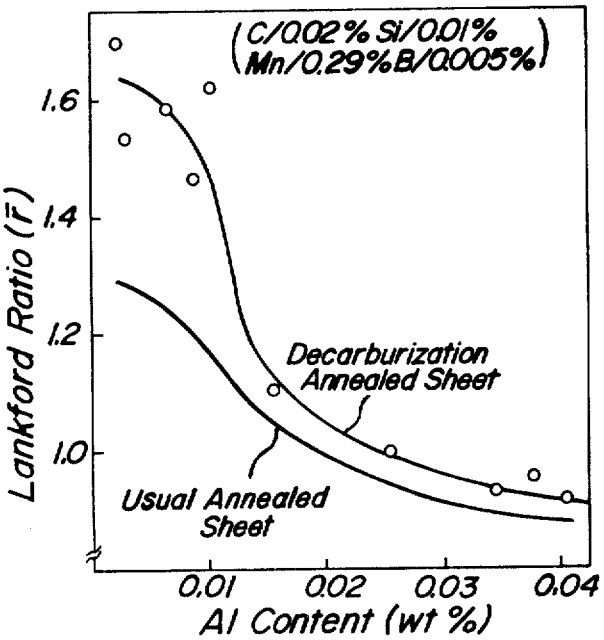
FIG. 2 is a graph showing the results of the measurement of the hydrogen permeation test.
Figure 3:
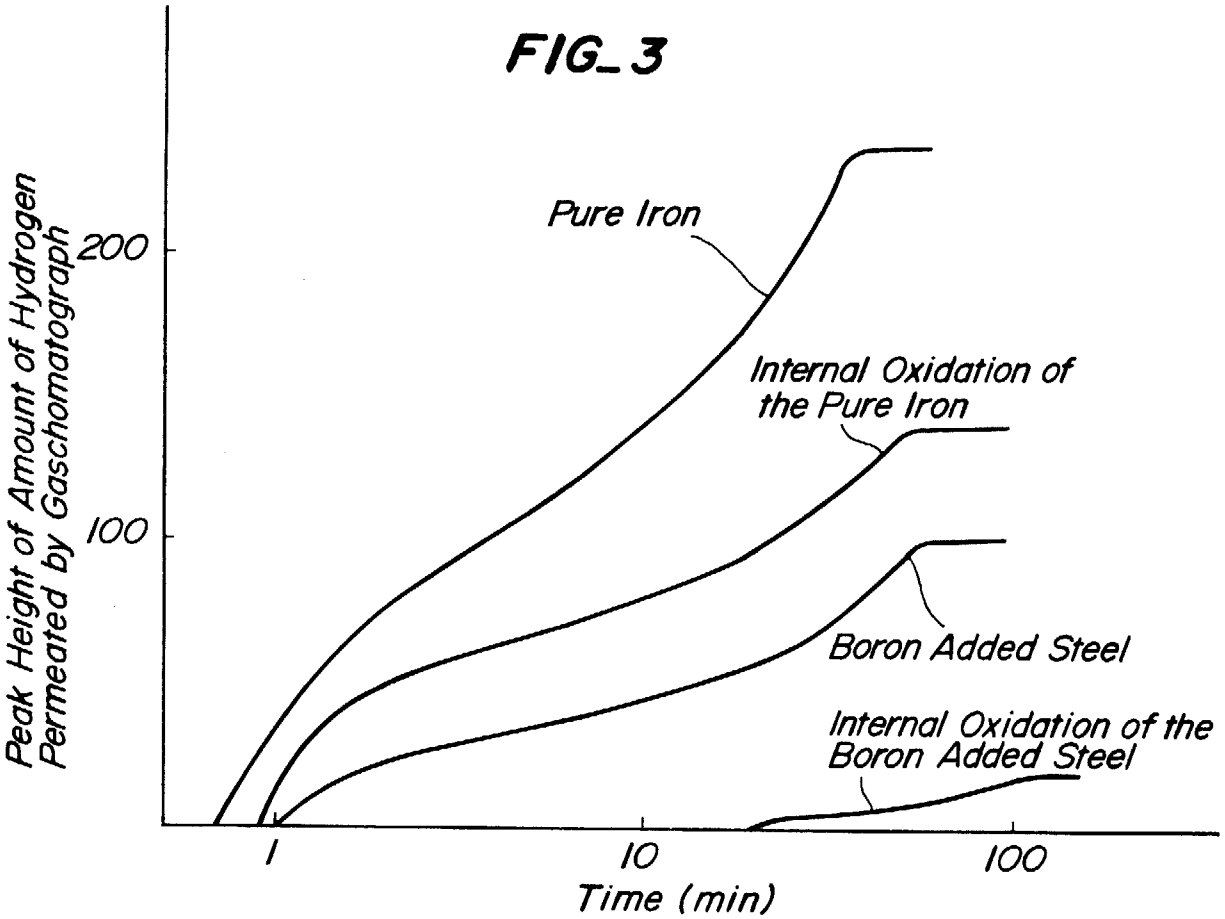
FIG. 3 is a graph showing the results of the hydrogen permeation test with respect to the pure iron, the internal oxidation of the pure iron, the boron added iron and the internal oxidation of the boron added iron.

The following examples are given for the purpose of illustration of this invention and are not intended as limitations thereof.

The steels having the components as shown in the following Table were molten and slabbed and then hot rolled into a sheet having a thickness of 2.8 mm at a finishing temperature of 860°C and a coiling temperature of 550°C. The hot rolled sheet was pickled and then cold rolled by a tandem roll into a sheet having a thickness of 0.8 mm, after which the resulting sheet was annealed in a bell type annealing furnace at a uniform temperature of 760°C or subjected to a decarburization annealing in an open annealing furnace at a uniform temperature of 700°C and then to a tempering rolling of 1%. The resulting steel sheets are subjected to the enameling treatment to obtain the results as shown in Table 1.

As the conditions for the enameling treatment, such pre-treatment steps that the fish scales and the other defects are liable to be caused were selected and the immersion in Ni bath which is practically inevitable was omitted and the frit for the high temperature firing was used.

Table 1

| | | Check analysis (wt.%) | | | | | | | | | | | | |
|---|---|---|---|---|---|---|---|---|---|---|---|---|---|---|
| Sample | No. | C | Si | Mn | P | S | Al | N | B | O | B×O ×10⁻³% | Annealing condition | Annealed sheet Check analysis C(wt.%) | Slab surface quality |
| | A | 0.006 | 0.013 | 0.15 | 0.011 | 0.014 | 0.006 | 0.0028 | 0.005 | 0.0118 | 5.9 | Box annealing (tight annealing) | 0.006 | Good |
| | B | 0.006 | 0.016 | 0.30 | 0.013 | 0.012 | 0.008 | 0.0036 | 0.005 | 0.0106 | 5.3 | " | 0.007 | " |
| | C | 0.011 | 0.017 | 0.29 | 0.010 | 0.014 | 0.005 | 0.0052 | 0.009 | 0.0095 | 8.6 | " | 0.011 | " |
| Present | D | 0.013 | 0.012 | 0.13 | 0.011 | 0.010 | 0.004 | 0.0032 | 0.003 | 0.0052 | 1.6 | " | 0.013 | " |

Table 1-continued

| Sample | No. | Check analysis (wt.%) C | Si | Mn | P | S | Al | N | B | O | B×O ×10⁻⁵% | Annealing condition | Annealed sheet Check analysis C(wt.%) | Slab surface quality |
|---|---|---|---|---|---|---|---|---|---|---|---|---|---|---|
| inven- | E | 0.010 | 0.008 | 0.32 | 0.019 | 0.012 | 0.006 | 0.0045 | 0.016 | 0.0070 | 11.2 | " | 0.009 | " |
| tion | F | 0.018 | 0.006 | 0.34 | 0.017 | 0.013 | 0.003 | 0.0084 | 0.006 | 0.0150 | 9.0 | " | 0.018 | " |
| | G | 0.014 | 0.015 | 0.14 | 0.011 | 0.008 | 0.008 | 0.0042 | 0.003 | 0.0108 | 3.2 | Decarburization annealing | 0.001 | " |
| | H | 0.018 | 0.017 | 0.17 | 0.012 | 0.007 | 0.009 | 0.0038 | 0.009 | 0.0110 | 9.4 | " | 0.002 | " |
| | I | 0.015 | 0.011 | 0.29 | 0.010 | 0.011 | 0.010 | 0.0032 | 0.005 | 0.0095 | 4.8 | " | 0.002 | " |
| | J | 0.015 | 0.018 | 0.32 | 0.009 | 0.008 | 0.009 | 0.0037 | 0.010 | 0.0150 | 15.0 | " | 0.003 | " |
| | K | 0.035 | 0.010 | 0.15 | 0.013 | 0.027 | 0.015 | 0.0050 | 0.013 | 0.0180 | 23.4 | Box annealing (tight annealing) | 0.034 | Bad |
| | L | 0.048 | <0.001 | 0.13 | 0.014 | 0.023 | 0.008 | 0.0078 | <0.001 | 0.0310 | <3.1 | " | 0.048 | " |
| | M | 0.050 | <0.001 | 0.29 | 0.008 | 0.006 | 0.033 | 0.0028 | 0.003 | 0.0057 | 1.7 | " | 0.049 | " |
| | N | 0.004 | 0.038 | 0.27 | 0.018 | 0.016 | 0.006 | 0.0078 | <0.001 | 0.0312 | <3.1 | " | 0.004 | Good |
| | O | 0.006 | 0.044 | 0 28 | 0.017 | 0.016 | 0.010 | 0.0036 | 0.004 | 0.0130 | 5.2 | " | 0.005 | " |
| Compar- | P | 0.008 | 0.020 | 0.35 | 0.012 | 0.011 | 0.007 | 0.0056 | 0.009 | 0.0580 | 52.2 | " | 0.008 | Bad |
| ative | Q | 0.004 | 0.021 | 0.32 | 0.013 | 0.010 | 0.008 | 0.0067 | <0.001 | 0.0040 | <0.4 | " | 0.004 | " |
| | R | 0.013 | 0.038 | 0.29 | 0.009 | 0.012 | 0.010 | 0.0008 | <0.001 | 0.0120 | <1.2 | Decarburization annealing | 0.001 | Good |
| | S | 0.018 | 0.009 | 0.30 | 0.012 | 0.016 | 0.002 | 0.0007 | <0.001 | 0.0723 | <7.2 | " | 0.002 | Partially bad |
| | T | 0.030 | 0.013 | 0.29 | 0.010 | 0.008 | 0.016 | 0.0032 | 0.009 | 0.0194 | 17.5 | " | 0.002 | Bad |
| | U | 0.010 | 0.016 | 0.18 | 0.012 | 0.011 | 0.008 | 0.0045 | 0.021 | 0.0330 | 69.3 | " | 0.003 | Good |

| Sample | No. | Mechanical properties Y.P.* Kg/mm² | T.S. Kg/mm² | El. (%) | $\bar{r}$ | Enamel properties Fish** scale generation (%) | Surface state | Adherence*** (P.E.I.) |
|---|---|---|---|---|---|---|---|---|
| | A | 20 | 30 | 51 | 1.33 | 0 | Good | 100 |
| | B | 18 | 29 | 51 | 1.26 | 0 | " | 100 |
| | C | 21 | 30 | 48 | 1.16 | 0 | " | 100 |
| Present | D | 18 | 29 | 51 | 1.38 | 0 | " | 100 |
| inven- | E | 21 | 30 | 48 | 1.14 | 0 | " | 100 |
| tion | F | 21 | 30 | 49 | 1.20 | 0 | " | 100 |
| | G | (15) | 28 | 57 | 1.72 | 0 | " | 100 |
| | H | (17) | 30 | 54 | 1.52 | 0 | " | 100 |
| | I | (16) | 29 | 56 | 1.62 | 0 | " | 100 |
| | J | (17) | 30 | 54 | 1.46 | 0 | " | 100 |
| | K | 22 | 31 | 49 | 1.02 | 0 | Pin-hole | 100 |
| | L | 22 | 31 | 50 | 1.03 | 8.3 | Bubble | 100 |
| | M | 22 | 32 | 47 | 0.93 | 83.3 | Rocal bubble | 100 |
| | N | 21 | 30 | 49 | 1.10 | 37.5 | Good | 52.7 |
| | O | 19 | 30 | 49 | 1.21 | 0 | " | 43.1 |
| Compar- | P | 24 | 32 | 47 | 0.98 | 0 | Rocal bubble | 100 |
| ative | Q | 16 | 27 | 53 | 1.42 | 75.0 | Good | 100 |
| | R | 19 | 30 | 50 | 1.37 | 75.0 | " | 43.1 |
| | S | 20 | 31 | 50 | 1.23 | 4.5 | Pin-hole | 88.3 |
| | T | 20 | 30 | 49 | 1.21 | 0 | " | 100 |
| | U | 20 | 31 | 48 | 1.05 | 0 | Good | 100 |

* ( ) is shown by 0.2% resistance

** Fish scale generation (%) = $\frac{\text{Sheet number generated fish scale}}{\text{Sample number (48)}} \times 100$

*** Adherence is measured by P.E.I. tester.

Y.P. Yield point

T.S. Tensile strength

El. Elongation

In the above Table, the adherence P.E.I.(%) was determined by means of Porcelain Enamel Institute adherence tester as follows.

The sample was subjected to a compression deformation and the glaze was forcedly exfoliated to measure electrically the exposed area of the base metal and calculate the area applied with the glaze on the deformed portion and the total area of the deformed portion to read as P.E.I.(%) and no exfoliation is expressed by 100% and the entirely exfoliated area is expressed by 0%. The method for measuring this index is described in ASTM C-313.

From the results of this test, it can be seen that even if the steel according to the present invention is enameled under the conditions which are apt to cause the defects, the very stable results can be obtained.

What is claimed is:

1. A method for producing cold rolled steel sheets having an excellent enamelability which comprises adding to a molten steel containing not more than 0.020% of carbon, not more than 0.03% of silicon, not more than 0.50% of manganese, not more than 0.01% of aluminum, not more than 0.050% of oxygen, and having a nitrogen content of less than 0.01%, and the remainder being inevitable impurities and iron, boron within a range of 0.005-0.020% being in such amounts of B(%)×O(%) of more than $1\times10^{-5}$ and hot rolling the resulting steel, cold rolling the steel, and subjecting to a recrystallization annealing under a decarburization atmosphere.

2. The method as claimed in claim 1, wherein upon the steel making, the carbon content is adjusted to 0.005–0.020% and at the recrystallization annealing, the decarburization is effected to reduce the carbon content to less than 0.005%.

3. The method as claimed in claim 1, wherein the boron content is 0.003–0.020%.

4. Cold rolled steel sheets made by the process of claim 1.

5. The cold rolled steel sheets as claimed in claim 4, wherein said boron content is 0.003–0.020%.

* * * * *